US006341396B1

(12) United States Patent
Carapezza

(10) Patent No.: US 6,341,396 B1
(45) Date of Patent: Jan. 29, 2002

(54) VARIABLE COVERAGE BED COVERING

(76) Inventor: Josephine Carapezza, 319 Franklin Tpke, Mahwah, NJ (US) 07430

( * ) Notice: Subject to any disclaimer, the term of this patent is extended or adjusted under 35 U.S.C. 154(b) by 0 days.

(21) Appl. No.: 09/569,448

(22) Filed: May 12, 2000

(51) Int. Cl.[7] ..... A47G 9/02
(52) U.S. Cl. ..... 5/482; 5/486
(58) Field of Search ..... 5/482, 486, 485, 5/495, 496, 499, 413 R

(56) References Cited

U.S. PATENT DOCUMENTS

| | | | | | |
|---|---|---|---|---|---|
| 2,689,961 | A | * | 9/1954 | Lieberthal | 5/486 |
| 2,730,728 | A | * | 1/1956 | Roberts | 5/486 |
| 3,072,776 | A | * | 1/1963 | Quenneville | 5/486 |
| 3,508,284 | A | | 4/1970 | Marquette | |
| 4,005,499 | A | | 2/1977 | Klein | |
| 5,023,969 | A | | 6/1991 | Nattrass | |
| 5,201,086 | A | * | 4/1993 | Decker et al. | 5/497 |
| 5,287,573 | A | * | 2/1994 | Ritacco | 5/486 |
| D379,893 | S | | 6/1997 | Dilbeck | |
| 5,943,717 | A | | 8/1999 | Alexander | |
| 5,960,492 | A | * | 10/1999 | Byrne | 5/413 R |

* cited by examiner

*Primary Examiner*—Lynne H. Browne
*Assistant Examiner*—Fredrick Conley

(57) ABSTRACT

A variable coverage bed covering for permitting a pair of occupants of a bed to individually adjust the position of a bed covering according to the body temperature of the occupant without affecting the coverage of the other occupant. The variable coverage bed covering includes a bed covering for covering a portion of a bed, and includes a flexible panel having a perimeter defined by a top edge, a bottom edge, and first and second side edges. A slit is formed in the flexible panel and the slit extends from the top edge toward the bottom edge. The slit extends substantially perpendicular to the top edge. The slit defines a first portion between the slit and the first side edge and a second portion between the slit and the second side edge. The slit is defined by a first free edge on the first portion and a second free edge on the second portion. A fastening structure is mounted on the panel for releasably securing the first free edge to the second portion and the second free edge to the first portion, and the fastening structure may comprise a plurality of releasable fastening components. The panel may have a substantially trapezoidal perimeter shape, with the first and second side edges converging toward the bottom edge and diverging toward the top edge. The panel may form a pair of corner pockets for securing a bottom portion of the panel to a mattress, one of the corner pockets being located at each junction of the bottom edge and one of the side edges defining a pocket for receiving a corner of a mattress.

12 Claims, 3 Drawing Sheets

FIG. 2
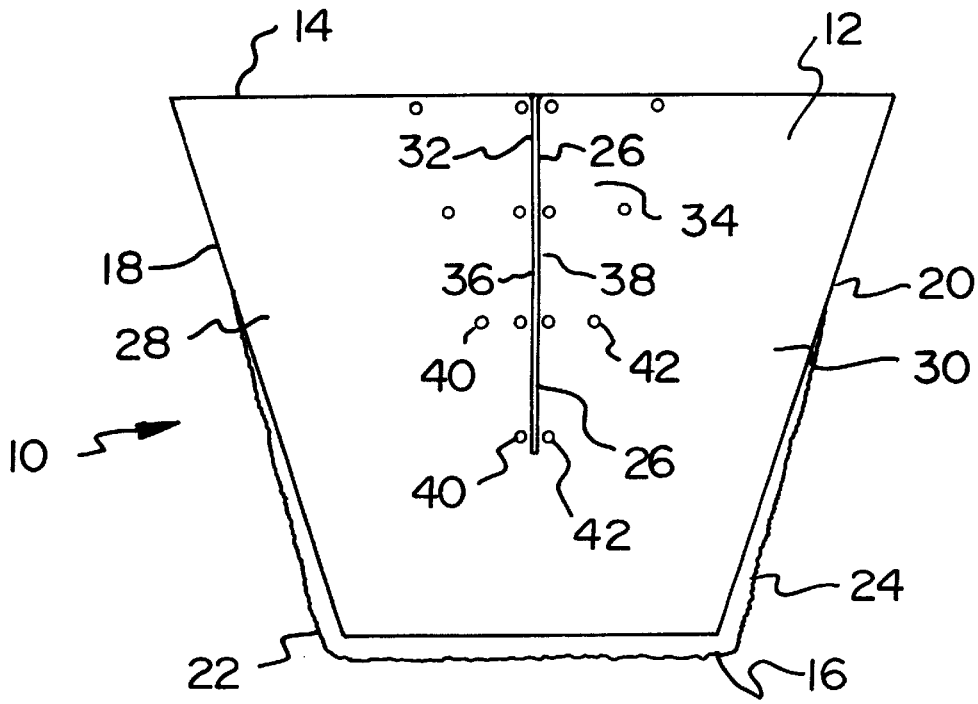
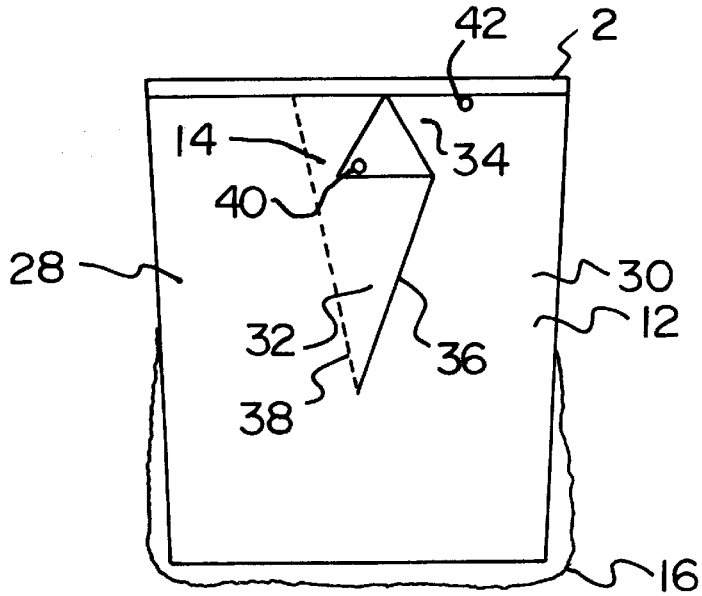
FIG. 3

VARIABLE COVERAGE BED COVERING

BACKGROUND OF THE INVENTION

1. Field of the Invention

The present invention relates to bed coverings and more particularly pertains to a new variable coverage bed covering for permitting a pair of occupants of a bed to individually adjust the position of a bed covering according to the body temperature of the occupant without affecting the coverage of the other occupant.

2. Description of the Prior Art

Occupants of the same bed often have different thermal needs from a bed covering (such as a blanket or a bed sheet) installed on the bed. One occupant often feels warmer than the other occupant, and the warmer occupant often attempts to turn down the portion of the bed covering directly overlying the warmer occupant, but often this action will remove a portion of the bed covering overlying the cooler occupant, especially if the occupants are lying in close proximity to each other, such as on a relatively narrow width bed.

The use of bed coverings that have been modified in an attempt to address this problem is known in the prior art. Known attempts at solving this problem have typically included some variation of two separate bed covering elements removably connected together at a location corresponding to a middle location on the bed so that one of the elements might be removed or adjusted separately of the other element. However, the separate elements always have the possibility of unintentionally becoming separated. Further, the known bed coverings have generally been bulky and relatively difficult to connect and disconnect, especially s one is lying in the bed during the night. Further, the known bed coverings are prone to being unintentionally removed from a tucked condition with respect to the mattress of the bed while each of the occupants is attempting to arrange the portions of the bed coverings to their liking.

In these respects, the variable coverage bed covering according to the present invention substantially departs from the conventional concepts and designs of the prior art, and in so doing provides an apparatus primarily developed for the purpose of permitting a pair of occupants of a bed to individually adjust the position of a bed covering according to the body temperature of the occupant without affecting the coverage of the other occupant.

SUMMARY OF THE INVENTION

In view of the foregoing disadvantages inherent in the known types of bed coverings now present in the prior art, the present invention provides a new variable coverage bed covering construction wherein the same can be utilized for permitting a pair of occupants of a bed to individually adjust the position of a bed covering according to the body temperature of the occupant without affecting the coverage of the other occupant.

The general purpose of the present invention, which will be described subsequently in greater detail, is to provide a new variable coverage bed covering apparatus and method which has many of the advantages of the bed coverings mentioned heretofore and many novel features that result in a new variable coverage bed covering which is not anticipated, rendered obvious, suggested, or even implied by any of the prior art bed coverings, either alone or in any combination thereof.

To attain this, the present invention generally comprises a bed covering for covering a portion of a bed, and includes a flexible panel having a perimeter defined by a top edge, a bottom edge, and first and second side edges. A slit is formed in the flexible panel and the slit extends from the top edge toward the bottom edge. The slit extends substantially perpendicular to the top edge. The slit defines a first portion between the slit and the first side edge and a second portion between the slit and the second side edge. The slit is defined by a first free edge on the first portion and a second free edge on the second portion. A fastening structure is mounted on the panel for releasably securing the first free edge to the second portion and the second free edge to the first portion, and the fastening structure may comprise a plurality of releasable fastening components. The panel may have a substantially trapezoidal perimeter shape, with the first and second side edges converging toward the bottom edge and diverging toward the top edge. The panel may form a pair of corner pockets for securing a bottom portion of the panel to a mattress, one of the corner pockets being located at each junction of the bottom edge and one of the side edges defining a pocket for receiving a corner of a mattress.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new variable coverage bed covering apparatus and method which has many of the advantages of the bed coverings mentioned heretofore and many novel features that result in a new variable coverage bed covering which is not anticipated, rendered obvious, suggested, or even implied by any of the prior art bed coverings, either alone or in any combination thereof.

It is another object of the present invention to provide a new variable coverage bed covering which may be easily and efficiently manufactured and marketed.

It is a further object of the present invention to provide a new variable coverage bed covering which is of a durable and reliable construction.

An even further object of the present invention is to provide a new variable coverage bed covering which is susceptible of a low cost of manufacture with regard to both materials and labor, and which accordingly is then susceptible of low prices of sale to the consuming public, thereby making such variable coverage bed covering economically available to the buying public.

Still yet another object of the present invention is to provide a new variable coverage bed covering which provides in the apparatuses and methods of the prior art some of the advantages thereof, while simultaneously overcoming some of the disadvantages normally associated therewith.

Still another object of the present invention is to provide a new variable coverage bed covering for permitting a pair of occupants of a bed to individually adjust the position of a bed covering according to the body temperature of the occupant without affecting the coverage of the other occupant.

Yet another object of the present invention is to provide a new variable coverage bed covering which includes a bed covering for covering a portion of a bed, and includes a flexible panel having a perimeter defined by a top edge, a bottom edge, and first and second side edges. A slit is formed in the flexible panel and the slit extends from the top edge toward the bottom edge. The slit extends substantially perpendicular to the top edge. The slit defines a first portion between the slit and the first side edge and a second portion between the slit and the second side edge. The slit is defined by a first free edge on the first portion and a second free edge on the second portion. A fastening structure is mounted on the panel for releasably securing the first free edge to the second portion and the second free edge to the first portion, and the fastening structure may comprise a plurality of releasable fastening components. The panel may have a substantially trapezoidal perimeter shape, with the first and second side edges converging toward the bottom edge and diverging toward the top edge. The panel may form a pair of corner pockets for securing a bottom portion of the panel to a mattress, one of the corner pockets being located at each junction of the bottom edge and one of the side edges defining a pocket for receiving a corner of a mattress.

Still yet another object of the present invention is to provide a new variable coverage bed covering that functions as a single one piece bed covering, while also permitting portions of the bed covering to be positioned individually of the other portion so that each occupant of the bed is able to adjust the coverage of the occupant substantially independent of the other occupant.

Even still another object of the present invention is to provide a new variable coverage bed covering that resists pulling of the bed covering off of the bed by the occupants while resting in the bed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic top view of the panel of the present invention shown in a spread out orientation.

FIG. 3 is a schematic top view of the panel present invention shown installed on a bed with a portion of one section of the panel turned down.

DESCRIPTION OF THE PREFERRED EMBODIMENT

Figure 1:
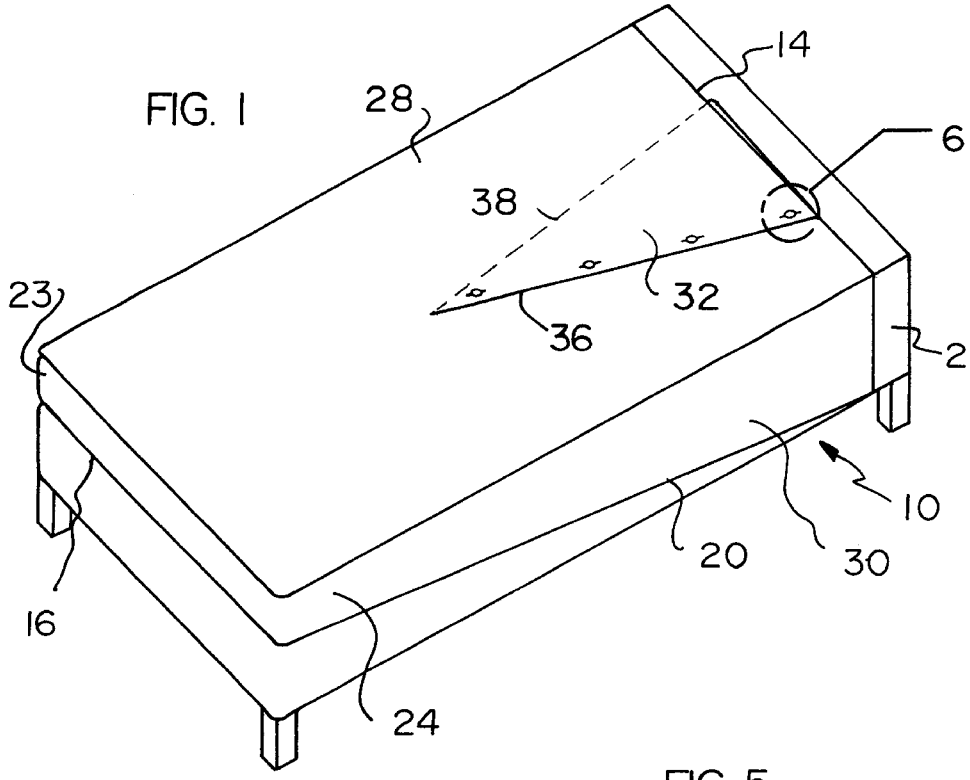
FIG. 1 is a schematic perspective view of a new variable coverage bed covering according to the present invention shown installed on a bed mattress.

With reference now to the drawings, and in particular to FIGS. 1 through 6 thereof, a new variable coverage bed covering embodying the principles and concepts of the present invention and generally designated by the reference numeral 10 will be described.

As best illustrated in FIGS. 1 through 6, the variable coverage bed covering 10 generally comprises a flexible panel of material, such as, for example, material typically used for forming blankets and even sheets. It should be seen that while the most preferred embodiment of the invention contemplates a blanket formed on a relatively heavier textile material, the aspects of the invention may also be applied to relatively thinner textile materials employed for sheet bed coverings.

The flexible panel 12 most preferably may have a substantially trapezoidal perimeter (see FIG. 2). The perimeter is defined by a top edge 14, a bottom edge 16, and first 18 and second 20 side edges. The top edge and the bottom edge may be oriented substantially parallel to each other. The first and second side edges may each be substantially linear or straight. To form the preferred trapezoidal shape, the first and second side edges may converge toward the bottom edge and consequently may diverge toward the top edge such that the top, bottom and side edges of the panel substantially form the trapezoidal perimeter shape. The trapezoidal shape of the panel provides additional panel material at a central location of the bed covering the when the panel is installed on a mattress or other sleeping surface on which bed coverings may be used.

Preferably, the panel is formed (such as, for example, by sewing) with a pair 22, 24 of corner pockets for securing a bottom portion of the panel to a mattress. Significantly, the pockets resist the tendency for manipulation of the panel by the occupants during sleep to dislodge the covering from its tucked condition under the mattress, thus exposing the feet and legs of the occupants from under the bed covering. One of the corner pockets is located at each junction of the bottom edge with one of the side edges 18, 20 to define a pocket for receiving a corner of a mattress. Illustratively, the pocket may be formed by attaching together (such as by sewing) the portions of the respective side edge with the bottom edge located adjacent to the corner of the panel. Optionally, an elastic element may be incorporated into the pocket for further security of mounting.

A slit 26 is provided in the flexible panel for permitting individualized adjustment of the panel coverage of the occupants while minimizing the effect on the coverage of the other occupant. The slit extends from the top edge 14 of the panel toward the bottom edge of the panel. The slit may be substantially linear and extend in a substantially perpendicular orientation with respect to the top edge. The slit may also be oriented substantially perpendicular to the bottom edge. The panel may have a length that is defined by a distance between the top and bottom edges (and defining a first distance).

The slit 26 defines a first portion 28 of the panel between the slit and the first side edge 18 and a second portion 30 of the panel between the slit and the second side edge 20. A first section 32 of the first portion 28 overlaps a second section 34 of the second portion 30 when the first 18 and second 20 side edges are oriented substantially parallel to each other, such as when the panel is installed on a mattress 2. The overlapped first and second sections reduce the air infiltration through the slit when the first and second sections are attached to each other. The first 18 and second 20 sections may be substantially triangular, such that the overlap between the first and second portions is a triangular area. The first section 32 has a first free edge 36 and the second section 34 has a second free edge 38, with the first and second free edges defining or forming the slit 26.

The slit extends a second distance that is measured from the top edge. Preferably, the second distance is at least approximately one half the first distance for permitting optimum individual movement of one portion of the panel with minimized effect on the other portion of the panel. Preferably the second distance is less than approximately three-quarters of the first distance to maximize the connection between the portions so that the effectiveness of the pockets of the panel is maintained, for example, by holding a degree of tension between the portions of the panel forming the pockets so that the pockets are held in engagement with the mattress.

Figure 5:
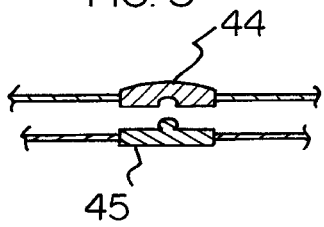
FIG. 5 is a schematic sectional view of the panel of the present invention showing an optional snap fastener.
Figure 6:
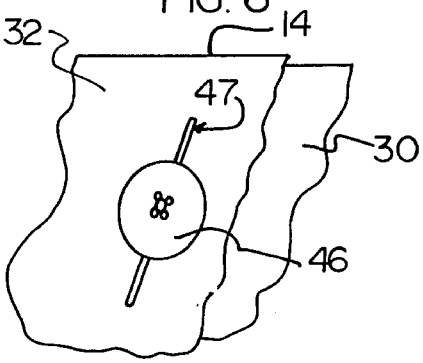
FIG. 6 is a schematic perspective view of a broken away portion of the panel of the present invention with an optional button fastener.
Figure 4:
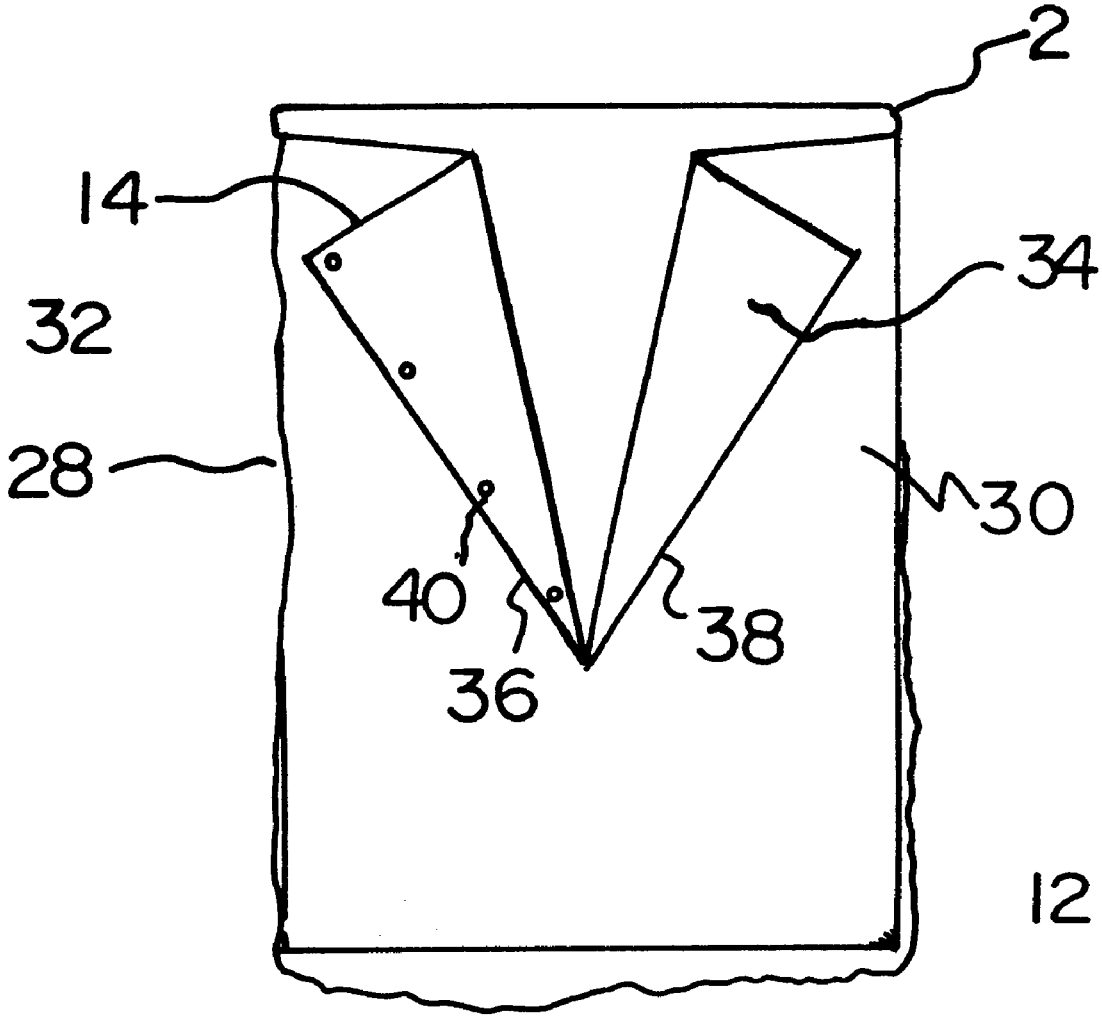
FIG. 4 is a schematic top view of the panel of the present invention shown installed on a bed with both sections turned down.

A plurality of releasable fastening components are mounted on the panel for releasably securing the first free edge to the second section and the second free edge to the first section so that the sections are releasably maintained in an overlapped condition when the fastening components are connected. The plurality of fastening components may include a number of first fastening elements 40 and a number of second fastening elements 42, with the first fastening elements being adapted to releasably connect to the second fastening elements. The first 40 and second 42 fastening elements are releasably connectable together. Illustratively, the first and second fastening elements may include, for example, the parts of snap-type fasteners 44, 45, as shown in FIG. 5, and button 46 and button hole 47 elements, as shown in FIG. 6.

The first fastening elements 40 are mounted on the first section and the second fastening elements 42 are mounted on the second section. The fastening elements extend from about the top edge to a lower extent of the slit, for permitting a substantially complete closure of the slit when the first and second fastening elements are connected. Preferably, the first fastening elements are positioned in a V-shaped configuration, with some of the first fastener elements being located along the first free edge and the remainder of the first fastener elements extending substantially in a line from a lower extent of the slit. Similarly, the second fastening elements are positioned in a V-shaped configuration, with some of the second fastener elements being located along the second free edge and the remainder of the second fastener elements extending substantially in a line from a lower extent of the slit. The V-shaped configurations of the first and second fastening elements overlie each other when the first and second sections are overlapped. The positioning of fastening elements along each free edge permits a relatively strong, yet easily releasable connection between the sections.

In use, the first and second sections of the panel of the bed covering may be fastened together while the occupants of the bed feel the need for the same need for coverage by the panel. When one of the occupants desires less coverage than the other occupant, the fasteners of the first and second sections may be disconnected from each other and one portion of the panel turned down individually of the other portion, so that one occupant receives less coverage than the other occupant. Occupants desiring greater coverage may then tuck their section of the panel underneath themselves, permitting even greater body heat retention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bed covering for covering a portion of a bed, comprising:

a flexible panel having a perimeter defined by a top edge, a bottom edge, and first and second side edges;

a slit formed in the flexible panel extending from the top edge toward the bottom edge, the slit extending substantially perpendicular to the top edge, the slit defining a first portion between the slit and the first side edge and a second portion between the slit and the second side edge, the slit being defined by a first free edge on the first portion and a second free edge on the second portion; and a plurality of releasable fastening components mounted on the panel for releasably securing the first free edge to the second portion and the second free edge to the first portion;

wherein the top edge has a length greater than a length of the bottom edge and the first and second side edges converge toward the bottom edge and diverge toward the top edge such that the top, bottom and side edges form a substantially trapezoidal perimeter shape so that a first section of the first portion overlaps a second section of the second portion when the first and second side edges are oriented substantially parallel to each other.

2. The bed covering of claim 1 wherein the top edge and the bottom edge are substantially parallel, the first and second side edges each being substantially linear.

3. The bed covering of claim 1 wherein the panel forms a pair of corner pockets for securing a bottom portion of the panel to a mattress, one of the corner pockets being located at each junction of the bottom edge and one of the side edges for receiving a corner of a supportive bed element.

4. The bed covering of claim 1 wherein the slit extends substantially perpendicular to the bottom edge.

5. The bed covering of claim 1 wherein a distance between the top and bottom edges defines a first distance, the slit extends a second distance from the top edge, and the second distance is at least approximately one-half the first distance.

6. The bed covering of claim 1 wherein a distance between the top and bottom edges defines a first distance, the slit extends a second distance from the top edge, and the second distance is less than approximately three-quarters of the first distance.

7. The bed covering of claim 1 wherein the plurality of releasable fastening components releasably secure the first and second sections with one of the sections overlapping the other of the sections.

8. The bed covering of claim 1 wherein the first and second sections are substantially triangular.

9. The bed covering of claim 1 wherein the first section has a first free edge and the second section having a second free edge, the first and second free edges defining the slit.

10. The bed covering of claim 1 wherein the plurality of fastening components includes first fastening elements and second fastening elements, the first and second fastening elements being releasably connectable together.

11. The bed covering of claim 10 wherein a first section of the first portion overlaps a second section of the second portion when the first and second side edges are oriented substantially parallel to each other, and wherein the first fastening elements are mounted on the first section and the second fastening elements are mounted on the second section.

12. A bed covering for covering a portion of a bed, comprising:

a flexible panel having a substantially trapezoidal perimeter, the perimeter being defined by a top edge, a bottom edge, and first and second side edges, the top edge and the bottom edge being substantially parallel, the first and second side edges each being substantially linear, the first and second side edges converging toward the bottom edge and diverging toward the top edge such that the top, bottom and side edges substantially form the trapezoidal perimeter shape;

the panel forming a pair of corner pockets for securing a bottom portion of the panel to a mattress, one of the corner pockets being located at each junction of the bottom edge and one of the side edges defining a pocket for receiving a corner of a mattress;

a slit formed in the flexible panel extending from the top edge toward the bottom edge, the slit extending substantially perpendicular to the top edge, the slit extending substantially perpendicular to the bottom edge, a distance between the top and bottom edges defining a first distance, the slit extending a second distance from the top edge, wherein the second distance is at least approximately one half the first distance, wherein the second distance is less than approximately three-quarters of the first distance;

the slit defining a first portion between the slit and the first side edge and a second portion between the slit and the second side edge, wherein a first section of the first portion overlaps a second section of the second portion when the first and second side edges are oriented substantially parallel to each other, the first and second sections being substantially triangular, the first section having a first free edge and the second section having a second free edge, the first and second free edges defining the slit; and a plurality of releasable fastening components mounted on the panel for releasably securing the first free edge to the second section and the second free edge to the first section, the plurality of fastening components including first fastening elements and second fastening elements, the first and second fastening elements being releasably connectable together, the first fastening elements being mounted on the first section and the second fastening elements being mounted on the second section.

* * * * *